US005121127A

United States Patent [19]

Toriyama

[11] Patent Number: 5,121,127

[45] Date of Patent: Jun. 9, 1992

[54] MICROSTRIP ANTENNA

[75] Inventor: Ichiro Toriyama, Kanagawa, Japan

[73] Assignee: Sony Corporation, Tokyo, Japan

[21] Appl. No.: 412,167

[22] Filed: Sep. 25, 1989

[30] Foreign Application Priority Data

| | | | |
|---|---|---|---|
| Sep. 30, 1988 | [JP] | Japan | 63-246490 |
| Dec. 29, 1988 | [JP] | Japan | 63-331494 |
| Jan. 31, 1989 | [JP] | Japan | 1-021172 |
| Jan. 31, 1989 | [JP] | Japan | 1-021173 |
| Feb. 2, 1989 | [JP] | Japan | 1-011747[U] |

[51] Int. Cl.[5] ..... H01Q 1/38

[52] U.S. Cl. ..... 343/700 MS; 343/830; 343/853

[58] Field of Search ..... 343/700 MS File, 829, 343/830, 846, 853, 852, 860, 826, 827

[56] References Cited

U.S. PATENT DOCUMENTS

| | | | |
|---|---|---|---|
| 3,545,002 | 12/1970 | Fenster | 343/830 |
| 4,401,988 | 8/1983 | Kaloi | 343/700 MS |
| 4,651,159 | 3/1987 | Ness | 343/700 MS |
| 4,827,271 | 5/1989 | Berneking et al. | 343/700 MS |

FOREIGN PATENT DOCUMENTS

| | | | |
|---|---|---|---|
| 0188087 | 7/1986 | European Pat. Off. | 343/700 MS |
| 31205 | 2/1982 | Japan | 343/700 MS |
| 29203 | 2/1983 | Japan | 343/700 MS |
| 48103 | 3/1987 | Japan | 343/700 MS |
| 2054275 | 2/1981 | United Kingdom | 343/700 MS |

OTHER PUBLICATIONS

"IEEE Transactions on Antennas and Propagation", vol. AP-32, No. 9, Sep. 1984, pp. 991-994, New York, U.S., J. Huang: Circularly Polarized Conical Patterns from Circular Microstrip Antennas.

Archiv Fuer Elektronik Und Uebertragungstechnik, vol. 36, No. 4, Apr. 1982, pp. 153-160, Wurzburg, DE, T. Scharten et al.; "Aperture Radiation from Circular Disk Antenna".

*Primary Examiner*—Michael C. Wimer

*Attorney, Agent, or Firm*—Ronald P. Kananen

[57] ABSTRACT

In the microstrip antenna apparatus according to the present invetnion, a circular radiation element is provided on a grounded conductive planar element through a dielectric layer having a small dielectric loss, and this radiation element resonates in the $TM_{01}$ mode. A feed point is located at substantially the center of the circular radiation element, and an impedance matching device is interposed between the feed point and a coaxial connector. The inside conductor of the impedance matching device is connected to the feed point to supply energy to the radiation element, and an outside conductor is connected to substantially the center of the conductive planar element so as to be grounded. Further, this antenna is provided on the microstrip antenna at its topmost portion in which a plurality of conductive planar elements are stacked thereby forming the microstrip antenna which is applicable to a plurality of frequencies.

17 Claims, 12 Drawing Sheets $d_1$=160mm $d_1 = 130mm$ $d_1 = 200mm$ f=4.2GHz f=1.6GHz

MICROSTRIP ANTENNA

BACKGROUND OF THE INVENTION

1. Field of the Invention

The present invention relates generally to microstrip antennas and more particularly to a microstrip antenna having a circular radiation element.

2. Description of the Prior Art

It has been proposed that a wireless communication system is established between a base station and a number of mobile stations via a geostationary satellite (see Japanese Pat. Application No. 63-331494).

FIG. 1 shows such a previously-proposed wireless communication system, in which a down channel between a base station CS and a number of mobile stations M is established via a geostationary satellite STd, while an up channel between the mobile stations M and the base station CS is established via a geostationary satellite STu. The frequencies of the up channel and the down channel are selected to be, for example, 1.6 GHz and 4.2 GHz, respectively. In this wireless communication system, a user HQ such as a transportation company and the base station CS are connected via another communication network line L, by way of example.

In the above-noted wireless communication system, the mobile station M side utilizes a microstrip antenna because it is simple in construction and has a low physical profile.

The microstrip antenna according to the prior art will be described with reference to FIGS. 2 and 3.

As shown in FIGS. 2 and 3, a circular radiation element 3 is laminated (i.e. stacked) on a rectangular ground plane conductor element 1 via a dielectric element 2 made of a material such as a fluoroplastics having a low dielectric loss. A feed point 3*f* is located at a position offset from the center of the circular radiation element 3, and is connected with an inside conductor 5 of a coaxial feed line 4. Reference numeral 6 designates an outside conductor forming the coaxial feed line 4.

When the circular radiation element 3 in this microstrip antenna resonates in the $TM_{11}$ mode (i.e. waveguide dominant mode), a surface current is distributed as shown by dashed lines in FIG. 2, and a directivity of the radiation becomes unilateral in which a maximum gain is provided in the front direction.

In the mobile wireless communication system utilizing a geostationary satellite or the like, the elevation angles of the geostationary satellite as seen from a mobile station falls within a range of from about 25 to 65 degrees in mid-latitudes.

When the prior-art microstrip antenna as described above is used in the mobile station side, the maximum gain direction of the antenna and the elevation angle of the geostationary satellite do not coincide with each other, degenerating the antenna gain.

In order to obtain a desired directivity that is matched with the angle of elevation of the geostationary satellite, it is generally proposed to provide a microstrip array antenna in which a plurality of microstrip antennas are properly connected to feed radiation elements with different phases.

This type of microstrip array antenna is, however, increased in size and becomes complicated in structure.

The mobile station side in the above-noted wireless communication system needs independent antennas respectively corresponding to the up channel and down channel.

IEEE Transactions on Antennas and Propagation (Vol. 27, No. 3, pp. 270 to 273, published on March, 1978), for example, reports a two-frequency antenna in which a non-feed circular conductor element is coaxially stacked (i.e. laminated) on the radiation element 3 of the prior-art microstrip antenna (shown in FIGS. 2 and 3) via the dielectric element.

This two-frequency antenna cannot cover two frequencies (1.6 GHz and 4.2 GHz) whose frequency ratio is very large, for example, about 1 : 2.6 as in the case where it is utilized in the afore-noted wireless communication system.

OBJECTS AND SUMMARY OF THE INVENTION

Accordingly, it is an object of the present invention to provide an improved microstrip antenna which can eliminate the defects encountered with the prior art.

It is another object of the present invention to provide a single microstrip antenna which has a directivity on a vertical plane in a range of a predetermined angle of elevation and has a non-directional radiation pattern on a horizontal plane.

It is still another object of the present invention to provide a microstrip antenna of a simplified arrangement which has a directivity on a vertical plane in a range about a predetermined angle of elevation in a plurality of frequency bands apart from each other and has a non-directional radiation pattern on a horizontal plane.

It is a further object of the present invention to provide a microstrip antenna in which a soldering process for connecting a portion having a large area is not needed and an antenna and a feed system can be positively connected mechanically and electrically with ease by a simple structure.

It is a yet further object of the present invention to provide a microstrip antenna which is thin in structure and in which the employment of a coaxial feed line and the soldering-process for connecting a portion having a large area are not needed, and an antenna, a feed circuit and a coaxial connector can be positively connected mechanically and electrically with ease.

In order to attain the above-noted objects, according to a microstrip antenna of this invention, a circular radiation element is provided on a grounded, conductive, planar element through a dielectric layer having a small dielectric loss, and a feed point is located at the center of this radiation element, whereby the radiation element resonates in the $TM_{01}$ mode.

According to the arrangement thus made, a main radiation beam has a vertically-polarized wave in a vertical plane in a range about a predetermined angle of elevation, and the radiation of the microstrip antenna of the invention is non-directional on a horizontal plane.

In accordance with another aspect of the present invention, there is provided a microstrip antenna in which a plurality of conductive circular elements are coaxially stacked on a grounded, conductive, planar element through dielectric layers of low dielectric loss in the sequential order of increasing diameters, a feed point is located at the center of the conductive circular element having the smallest diameter and feed points are provided on other conductive circular elements at respective position offset from the centers thereof, whereby the conductive circular element having the smallest diameter resonates in the $TM_{01}$ mode.

According to the arrangement as described above, the conductive circular element having the smallest diameter operates as a radiation element for the highest frequency band, and other conductive circular elements operate as radiation elements for lower frequency bands as well as operate as grounded, planar, conductive elements for adjacent smaller-diameter conductive circular elements, whereby the microstrip antenna of the invention is made small in size and simplified in structure and provides a directivity of a desired conical-beam shape over a plurality of frequency bands.

These and other objects, features and advantages of the present invention will be apparent from the following detailed description of preferred embodiments when read in conjunction with the accompanying drawings in which like reference numerals are used to identify the same or similar parts in the several views.

DETAILED DESCRIPTION OF PREFERRED EMBODIMENTS

A microstrip antenna according to an embodiment of the present invention will now be described with reference to FIGS. 4 to 10.

Figure 1:
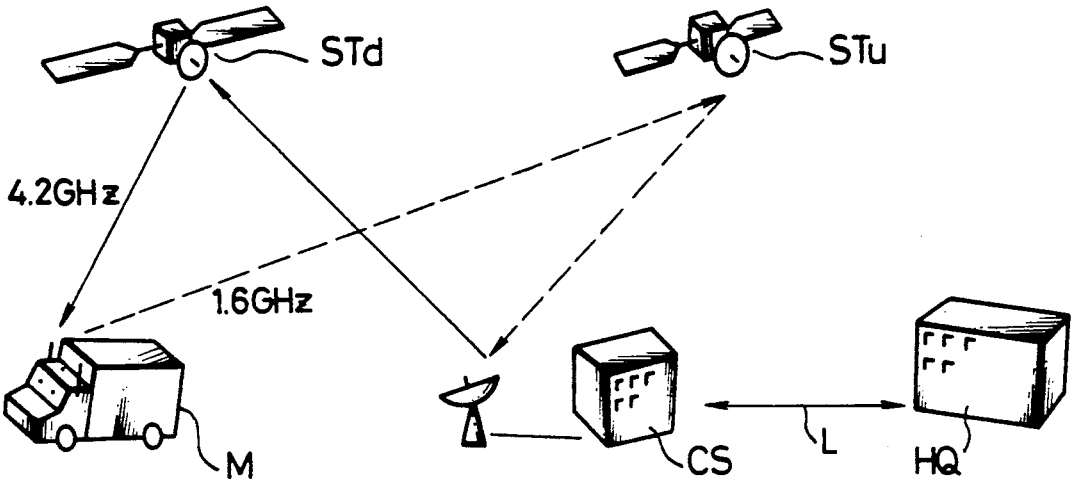
FIG. 1 (PRIOR ART)
FIG. 1 shows a mobile wireless communication system utilizing geostationary satellites according to the prior art.
Figure 2:
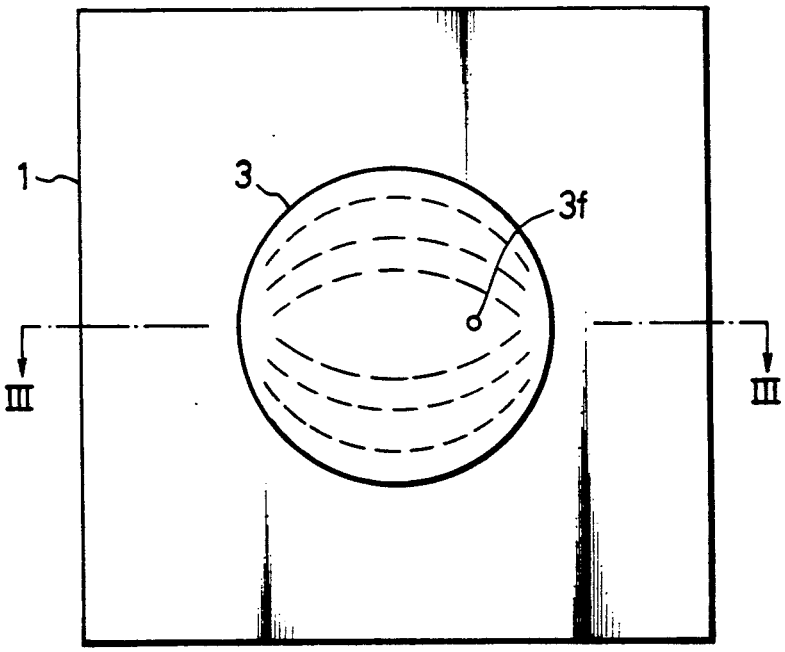
FIG. 2 (PRIOR ART)
FIG. 2 is a top plan view of a microstrip antenna according to the prior art.
Figure 3:
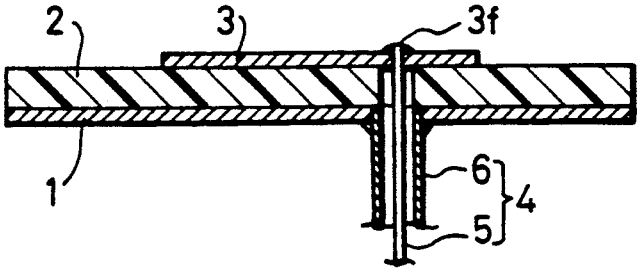
FIG. 3 (PRIOR ART)
FIG. 3 shows of a section of the prior-art microstrip antenna, of FIG. 2 in cross-section along line III—III.
Figure 4:
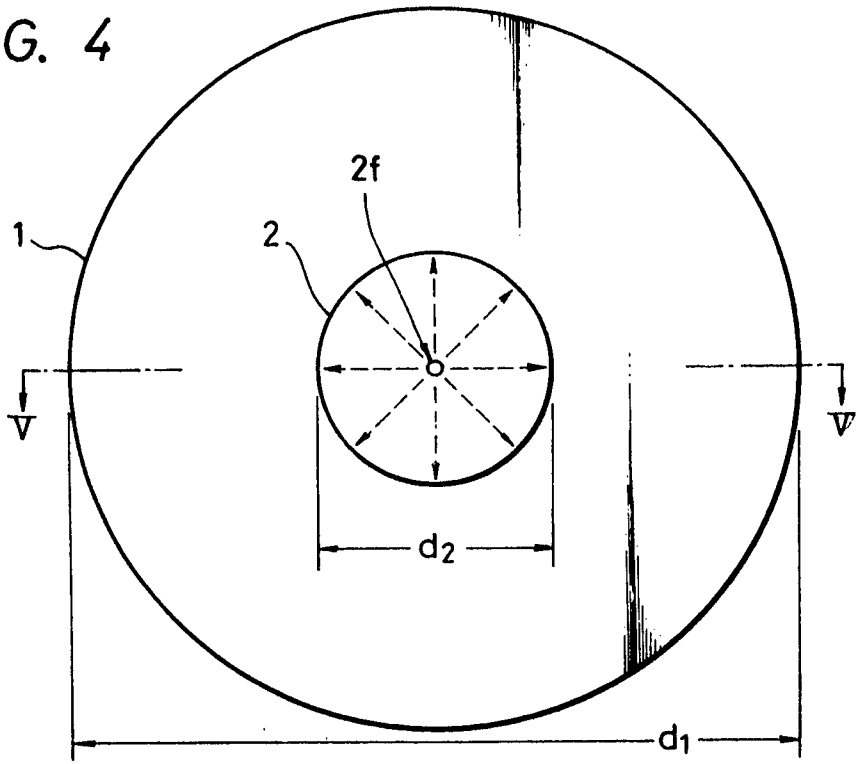
FIG. 4 is a top plan view illustrating a microstrip antenna according to an embodiment of the present invention.
Figure 5:
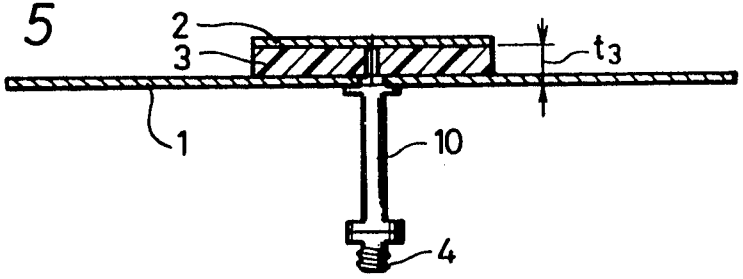
FIG. 5 shows the microstrip antenna of FIG. 4 in cross section along line V—V.

The arrangement of the embodiment of the present invention is represented in FIGS. 4 and 5. In FIGS. 4 and 5, like parts corresponding to those of FIGS. 2 and 3 are marked with the same references and therefore need not be described fully.

It will be seen in FIGS. 4 and 5 that a circular ground planar conductive element 1 and a circular radiation element 2 have interposed therebetween a dielectric substrate 3 which has the same diameter as that of the radiation element 2 and which is made of a material such as a fluoroplastic having a low dielectric loss. For example, the ground planar conductive element 1 has a diameter $d_l$ of 160 mm, and the radiation element 2 has a diameter $d_2$ of 53 mm. A thickness t3 of dielectric substrate 3 is, for example, 1.6 mm and a dielectric constant $\epsilon_r$ of dielectric substrate 3 is about 2.6.

In this embodiment, as shown in FIGS. 4 and 5, a feed point 2*f* is provided at the center of the radiation element 2, and an impedance matching device 10 is interposed between the feed point 2*f* and a coaxial connector 4.

Figure 6:
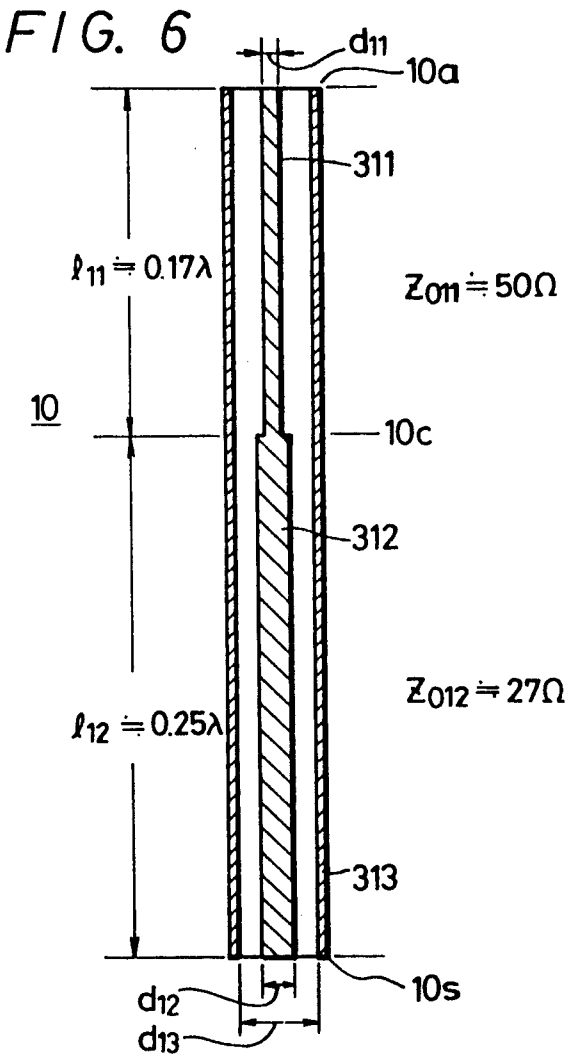
FIG. 6 shows in cross-section a main component of the microstrip antenna according to the present invention.

As shown in FIG. 6, the impedance matching device 10 is formed by coaxially providing inside conductors 311 and 312, which have predetermined lengths and have different diameters, within a common external conductor 313.

An impedance $Z_0$ of the microstrip antenna in this embodiment is expressed, as will be discussed below, as follows when the drive frequency is 4.185 GHz.

$$Z_{0a}=52.207\Omega-j68.215\Omega$$

In association with the above-noted impedance $Z_0$, diameters $d_{11}$ and $d_{12}$ of inside conductors 311 and 312 are 1.0 mm and 1.5 mm, and lengths $l_{11}$ and $l_{12}$ thereof are 12 mm and 18 mm, respectively. Further, an inside diameter of external conductor 313 is selected to be, for example, 2.3 mm.

A distant electric field of the circular microstrip antenna is generally expressed by the following equation (1) in a polar coordinate system in which the center of the radiation element is at the origin.

$$\left.\begin{aligned} E_\gamma &= 0 \\ E_\theta &= -j^n(k_0a)\frac{e^{-jk0r}}{r}\cdot\frac{V0}{2}\times \\ &\quad B_M(K_0a\sin\theta)\cos n\phi \\ E_\phi &= j^n(k_0a)\frac{e^{-jk0r}}{r}\cdot\frac{V0}{2}\times \\ &\quad B_p(K_0a\sin\theta)\cos\theta\sin n\phi \end{aligned}\right\} \quad (1)$$

where $$V_0 = tE_0Jn(ka)$$

$$B_p(x) = J_{n-1}(x) + J_{n+1}(x) = \frac{2n}{x}Jn(x)$$

$$B_M(x) = J_{n-1}(x) - J_{n+1}(x) = 2\frac{d}{dx}Jn(x)$$

$$k_0 = 2\pi/\lambda,\ k = k_0\cdot\sqrt{\epsilon r}$$

In the equation (1), Jn(x) represents the n- the order Bessel function, a the radius of radiation element, t the thickness of the dielectric substrate and λ the wavelength. Further, $E_0$ represents a constant.

In the equation (1), only the terms of θ and ϕ represent the radiation pattern directivity of an antenna so that, if they are represented as Dθ and Dϕ, they yield the following equations (2).

$$\left.\begin{aligned} D_\theta &= -B_M(k_0a\sin\theta)\cos\phi \\ D_\phi &= B_p(k_0a\sin\theta)\cos\theta\sin n\phi \end{aligned}\right\} \quad (2)$$

When the circular microstrip antenna resonates in the $TM_{01}$ mode, then n=0 is established in the equations (1), and accordingly, in the equation (2). Thus, the following equalities are satisfied.

$$[B_p(x)]_{n=0} = \left[\frac{2n}{x}Jn(x)\right]_{n=0} = 0$$

$$[B_M(x)]_{n=0} = \left[2\frac{d}{dx}Jn(x)\right]_{n=0} = [-2J_{n+1}(x)]_{n=0} = -2J_1(x)$$

Hence, this modifies the equation (2) as the following equation (3)

$$\left.\begin{aligned} D_\theta &= 2J_1(k_0a\sin\theta) \\ D_\phi &= 0 \end{aligned}\right\} \quad (3)$$

Thus, when the microstrip antenna resonates in the $TM_{01}$ mode, the radiation electric field of the circular microstrip antenna contains only the θ component and the magnitude thereof is expressed by the function of only θ regardless of ϕ. In other words, the radiation electric field is a vertical polarized wave and is non-directional on a horizontal plane.

The radius a of the radiation element is expressed by the following equation (4).

$$a = \frac{x_{01}c}{2\pi\sqrt{\epsilon r}\ f} + \alpha = \frac{x_{01}}{2\pi\sqrt{\epsilon r}}\lambda + \alpha \quad (4)$$

$$\text{where } \frac{d}{dx}J_0(x_{01}) = 0$$

In the equation (4), α represents a correction term for the thickness t of the dielectric element, and α is obtained experimentally. The thickness t of the dielectric element is determined in association with the radiation characteristic of the antenna.

The impedance seen from the feed point of the circular microstrip antenna is expressed by the following equation (5), where ρ assumes a distance between the center of the radiation element and the feed point.

$$Z_0\alpha Jn(k\rho) \quad (5)$$

If ρ=0, all values of the Bessel function higher than first-order become zero, and only the 0-order Bessel function $J_0(0)$ takes a finite value. That is, only when the radiation element resonates in the $TM_{01}$ mode, is the radiation element fed at its center.

Further, the surface current in this case is radially distributed from the central feed point to the peripheral edge as shown by dashed lines in FIG. 4, so that the directivity on a vertical plane can be prevented from being displaced unlike the case where the radiation element is fed at its feed point offset from its center.

In this embodiment, let us assume that the diameters $d_1$ and $d_2$ of the ground planar conductive element 1 and the radiation element 2 are 160 mm and 53 mm and that the thickness $t_3$ and the dielectric constant εr of the dielectric substrate 3 are 1.6 mm and 2.6, respectively. Then, when the drive frequency is 4.185 GHz, the impedances of the antenna in the $TM_{01}$ mode without, and with the impedance matching device 10, are respectively given by the following equations:

$$Z_{0s} = 46.906\Omega + j5.0215\Omega$$

$$Z_{0a} = 52.207\Omega - j68.215\Omega$$

Figure 7:
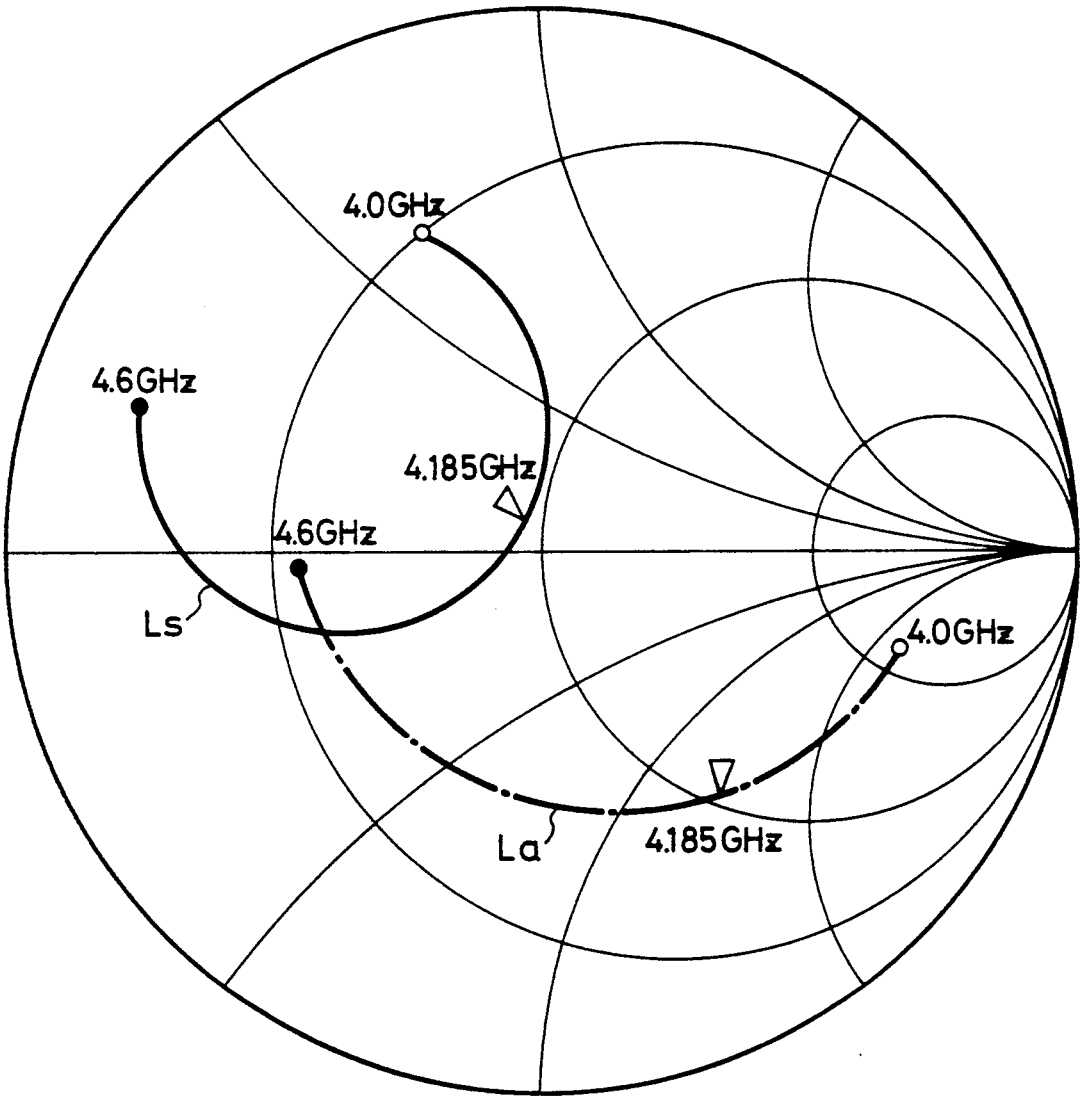
FIG. 7 is a plat showing how the impedance of the microstrip antenna of the invention changes with drive frequency.

Thus, the impedances are varied in a range of frequency from 4.0 to 4.6 GHz as shown by solid and one-dot chain line curves Ls and La in FIG. 7.

Further, calculating the radius of the radiation element from the equation (4) under the condition that $x_{01}$= 3.83171 and that f=4.185 GHz yields $$x_{01}\ C/2\pi f\sqrt{\gamma r} \approx 27.1 \text{ mm}$$

In practice, when the radius of the radiation element 2 is $d_2/2$=26.5 mm, the radiation element 2 resonates at the drive frequency, and a difference between the calculated radius and the radius in practice represents a correction amount α.

Figure 8:
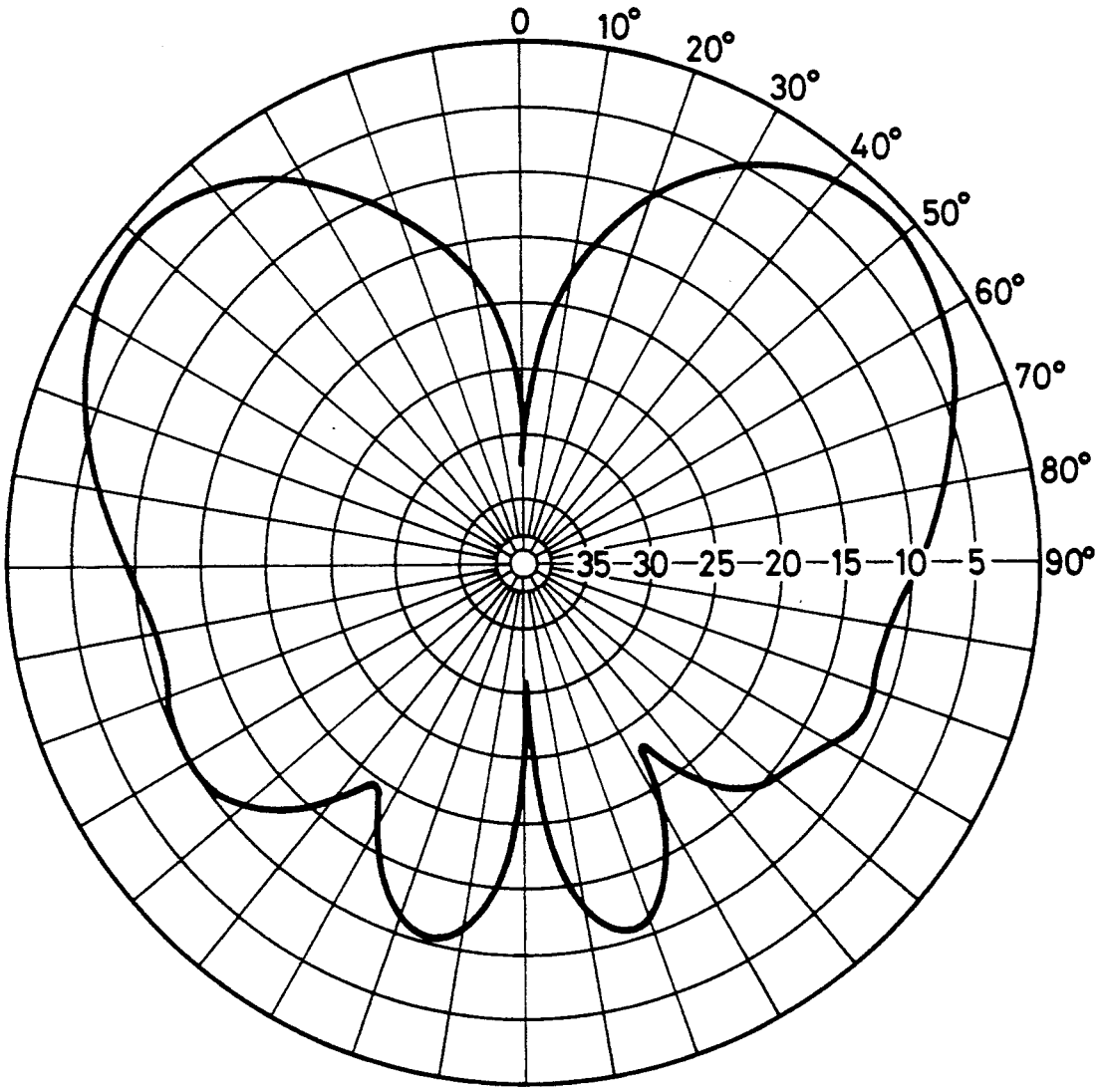
FIG. 8 shows a typical H-plane radiation pattern for the microstrip antenna of the invention in which the diameter of the ground plane conductor is 160 mm.
Figure 9:
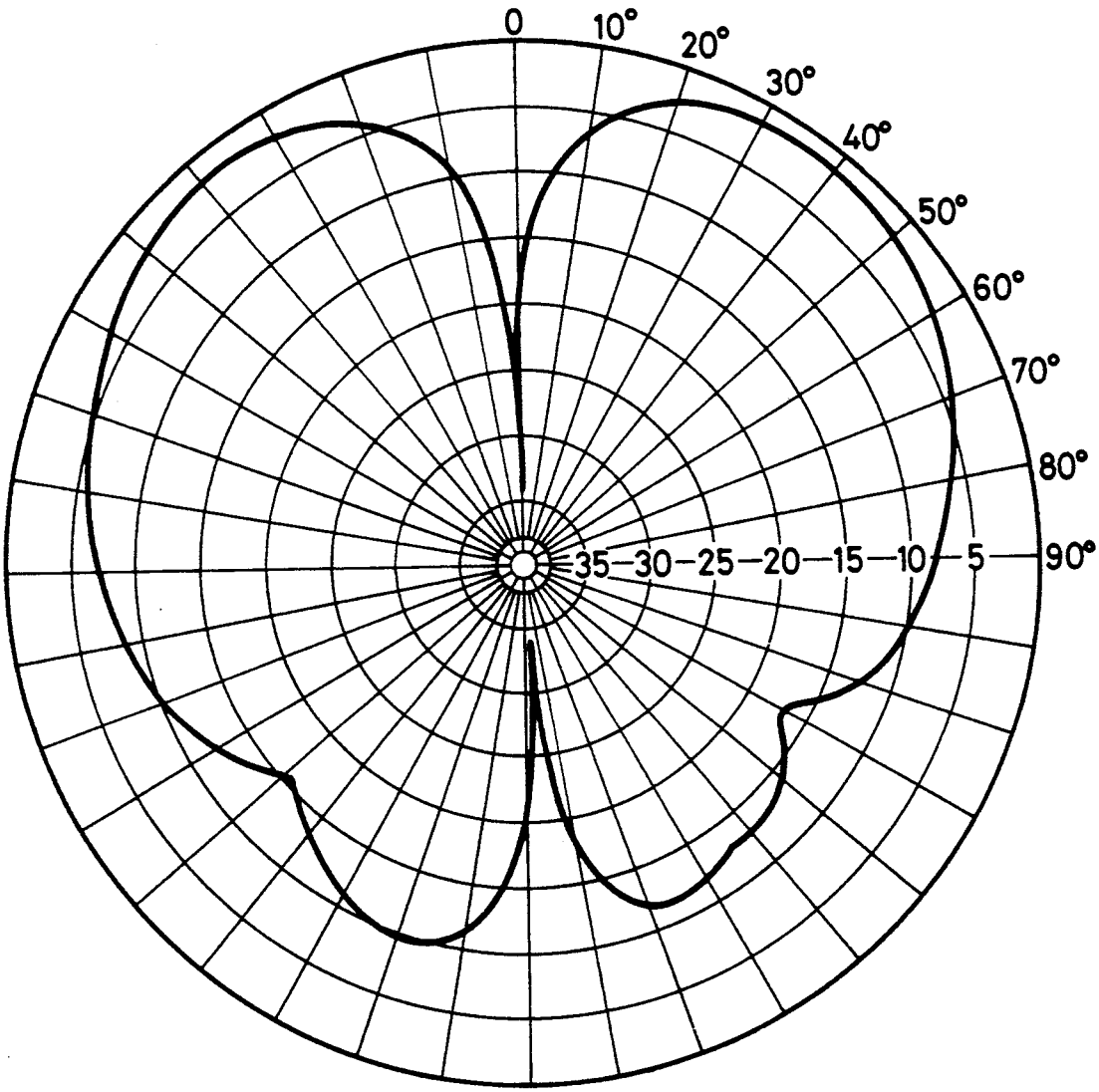
FIG. 9 shows a typical H-plane radiation pattern for the microstrip antenna of the invention in which the diameter of the ground plane conductor is 130 mm.
Figure 10:
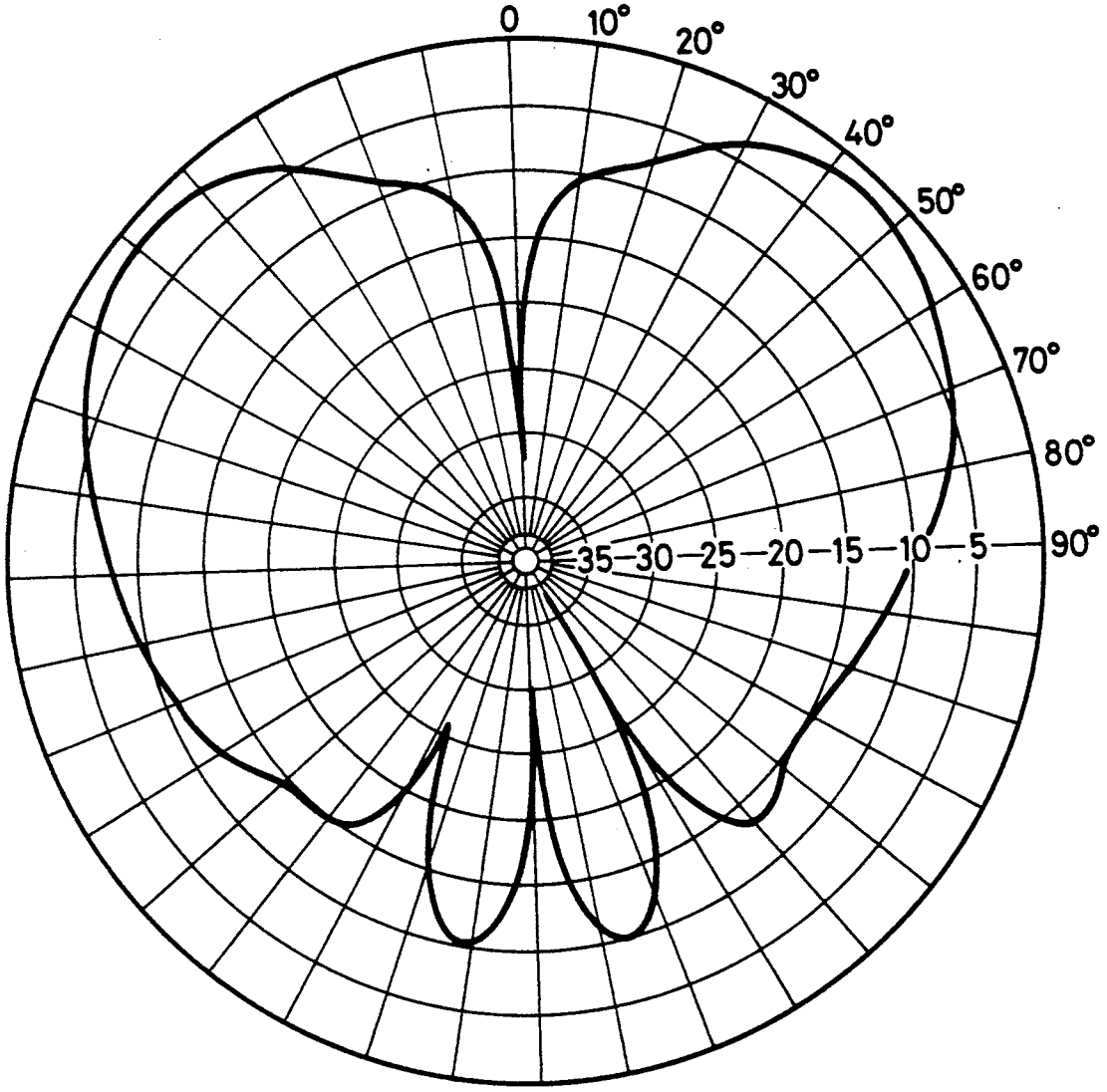
FIG. 10 shows a typical H-plane radiation pattern for the microstrip antenna of the invention in which the diameter of the ground plane is 200 mm.

When the diameter $d_1$ of the ground planar conductive element 1 is 160 mm, the directivity on the vertical plane of the antenna in this embodiment is represented as shown in FIG. 8 in which the maximum gain is provided at the elevation angle of about 45 degrees. When the diameters $d_1$ of the ground planar conductive element 1 are 130 mm and 200 mm, the elevation angles at which the maximum gain is provided are changed as about 50 degrees and 40 degrees as shown in FIGS. 9 and 10, respectively.

As described above, the main radiation beam of the microstrip antenna in this embodiment can cover the range of elevation angles of the geostationary satellite in the above-mentioned middle latitude area. Further, since the microstrip antenna in this embodiment has non-lateral directivity on the horizontal plane, this microstrip antenna is suitable for application to the mobile station in the wireless communication system utilizing a geostationary satellite.

Furthermore, the main radiation beam can be lowered by increasing the dielectric constant of the dielectric substrate 3.

In addition, the ground planar conductive element 1 can be prepared in a separated form of the portion contacting with the dielectric substrate 3 and a peripheral portion, and these portions may be connected electrically and mechanically.

The microstrip antenna according to a second embodiment of the present invention will be described with reference to FIGS. 11 and 12.

Figure 11:
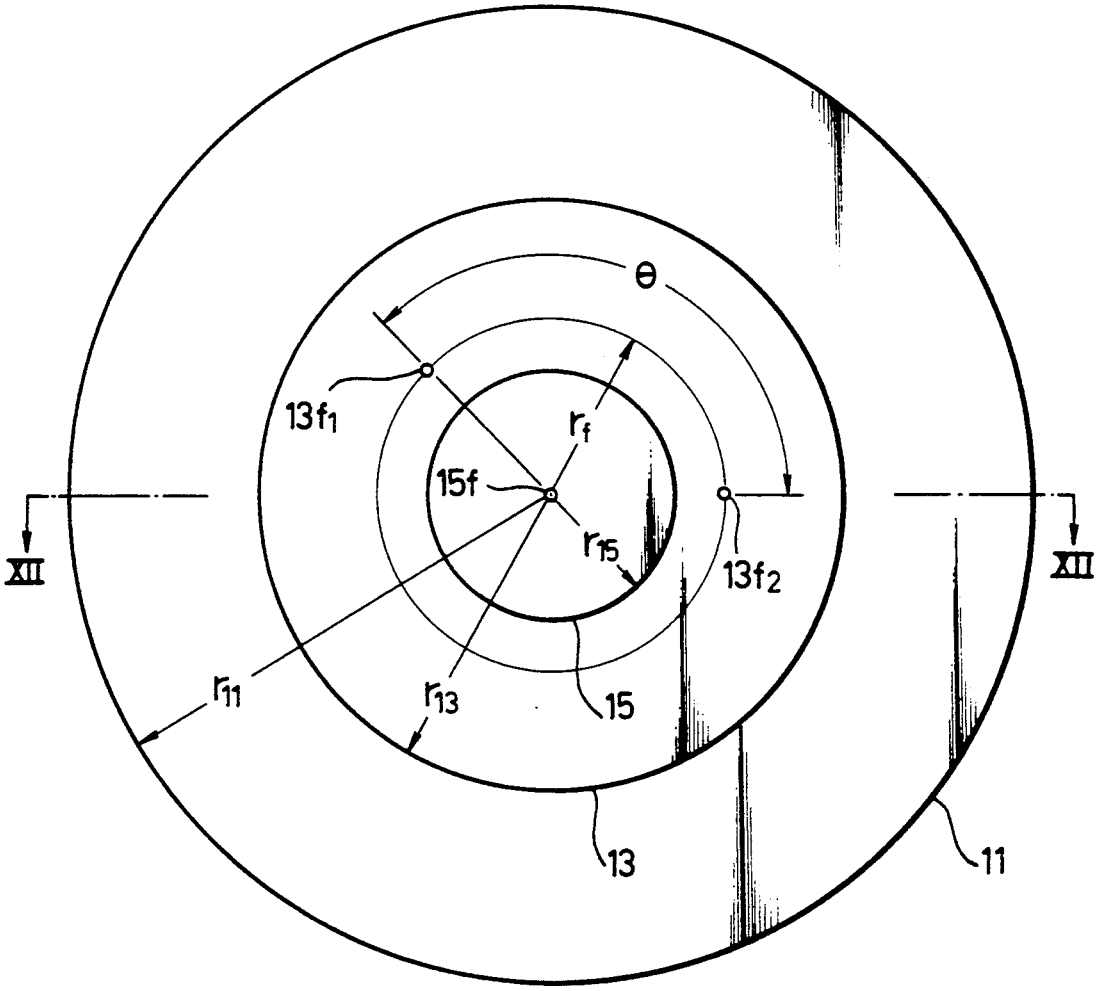
FIG. 11 is a top plan view illustrating the microstrip antenna according to a second embodiment of the present invention.
Figure 12:
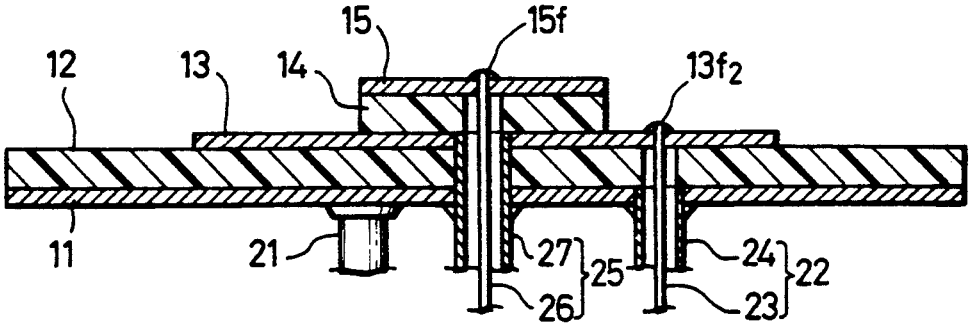
FIG. 12 shows the microstrip antenna, of FIG. 11 in cross-section along line XII—XII.

As shown in FIGS. 11 and 12, a circular conductive element 13 having a middle-sized diameter is coaxially stacked on a circular ground planar conductive element 11 having a largest diameter via a dielectric layer 12 having a large diameter and made of a material such as fluoroplastics of low dielectric loss. A circular conductive element 15 having a small diameter is coaxially stacked on the circular conductive element 13 via a dielectric layer 14 having a small diameter.

In this embodiment, radii $r_{11}$, $r_{13}$ and $r_{15}$ of the respective circular conductive elements 11, 13 and 15 are selected to be 90 mm, 55 mm and 26.5 mm, and dielectric constants $\approx r$ and thicknesses $t_{12}$ and $t_{14}$ of the dielectric layers 12 and 14 are selected to be 2.6 and 3.2 mm, respectively.

As shown in FIG. 11, feed points 13$f_1$ and 13$f_2$ are respectively provided on the circular conductive element 13 having the middle-sized diameter at two positions equally offset from the center of the conductive element 13 by the distance $r_f$ and having an angular spacing $\theta$ therebetween. A feed point 15*f* is provided at the center of the circular conductive element 15 having the small diameter.

In this embodiment, the offset distance $r_f$ of the feed points 13$_{f1}$ and 13$_{f2}$ and the angular spacing $\theta$ between the feed points 13$_{f1}$ and 13$_{f2}$ are respectively determined as $r_f = 33$ mm, and $\theta = 135$ degrees, by way of example.

As shown in FIG. 12, the feed points 13$f_1$ and 13$_{f2}$ of the circular conductive element 13 having the middle-sized diameter are respectively connected with coaxial feed lines 21 and 22. The outside conductor of the feed line 21 and the outside conductor 24 of the feed line 22 are both connected to the ground planar conductive element 11.

The feed point 15*f* of the circular conductive element 15 having the small diameter is connected with an inside conductor 26 of a coaxial feed line 25, and an outside conductor 27 of the feed line 25 is connected to the ground planar conductive element 11.

In this embodiment, the middle-sized diameter circular conductive element 13 is electrically connected at its center to the ground planar conductive element 11 by a through-hole forming-process, whereby the outside conductor 27 of the coaxial feed line 25 is connected to the central portion of the middle-sized diameter circular conductive element 13.

The operation of this embodiment will be described as follows.

Figure 13:
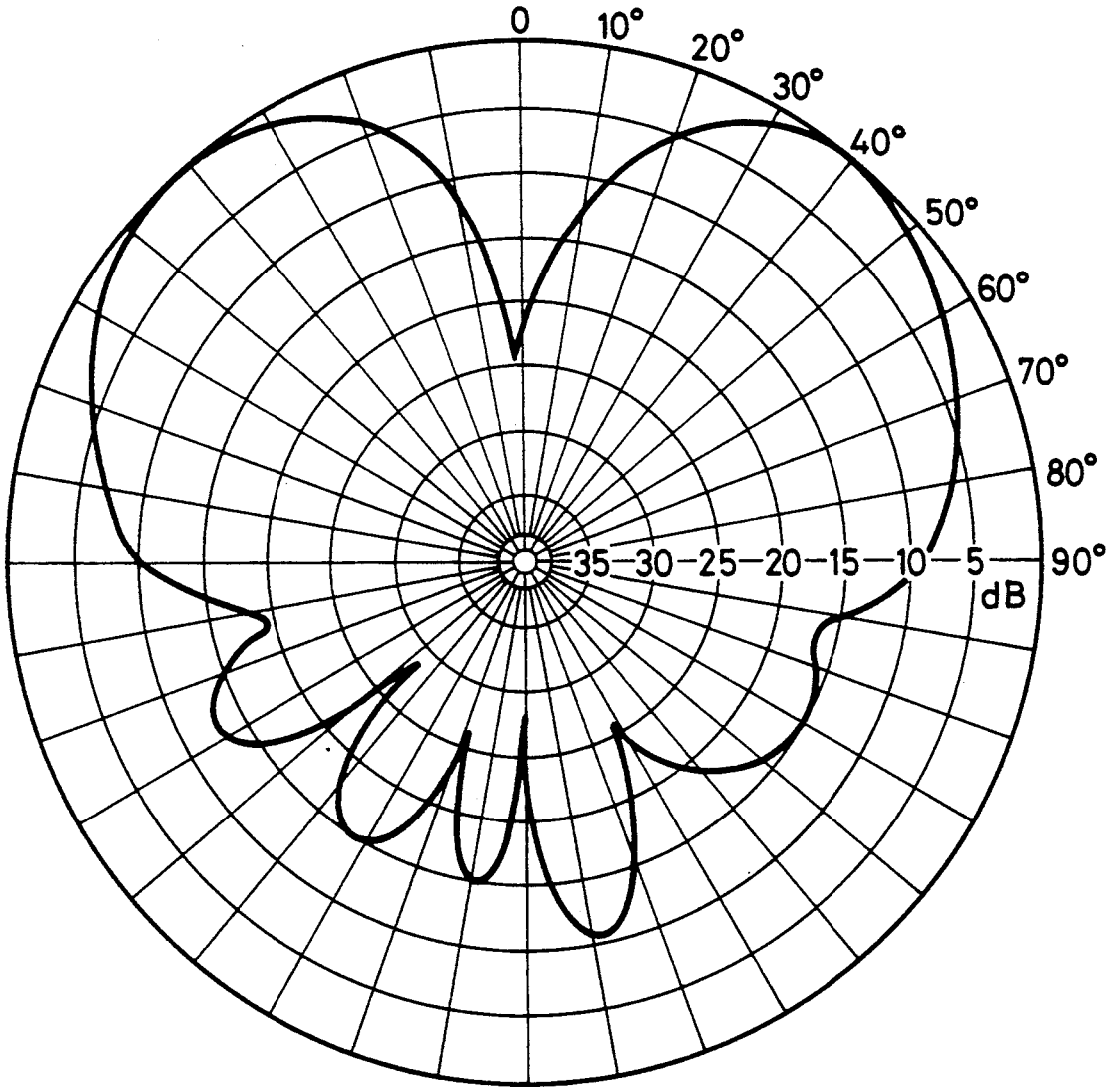
FIG. 13 shows a typical H-plane radiation pattern for the microstrip antenna of the second embodiment in which the radiation element is resonated at frequency of 4.2 GHz.

The circular conductive element 15 of a small diameter is fed at its center and its radius $r_{15}$ is 26.5 mm, whereby it resonates at the frequency of 4.2 GHz in the $TM_{01}$ mode and becomes a radiation element for radiating a vertically-polarized wave. In that event, the circular conductive element 13 functions as a ground planar conductive element relative to the circular conductive element 15 so that it provides a directivity on a vertical plane in which its main beam falls in a range of desired angle of elevation as shown in FIG. 13.

Figure 14:
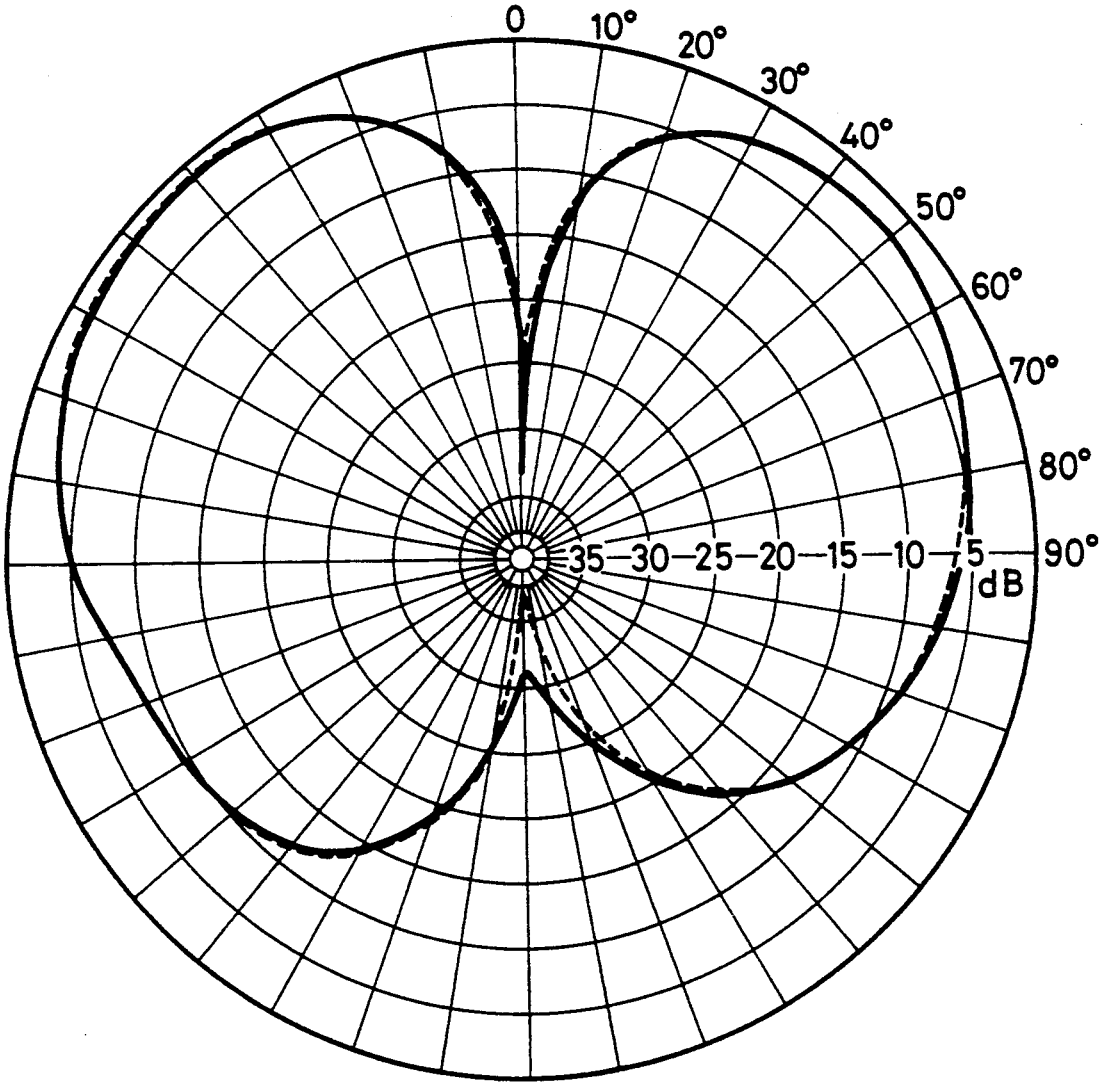
FIG. 14 shows a typical H-plane radiation pattern for the microstrip antenna of the second embodiment in which the radiation element is resonated at frequency of 1.6 GHz.

The circular conductive element 13, on the other hand, resonates in the $TM_{21}$ mode by a signal having a frequency of 1.6 GHz applied to the first feed point 13$_{f1}$ having the impedance of 50Ωand at a reference phase (0 degree) and to the second feed point 13$_{f2}$ having the impedance 50Ωand at a phase of −90 degrees. Thus, the circular conductive element 13 becomes a circular polarized wave radiation element which provides a desired directivity on a vertical plane as shown in FIG. 14.

Since the impedance at the center of the radiation element is fundamentally 0Ωin other modes than the $TM_{01}$ mode, in this embodiment, the operation of the microstrip antenna in this embodiment can be stabilized by connecting the central portion of the cicular conductive element 13 of a middle-sized diameter to the ground planar conductive element 11.

In this embodiment, the microstrip antenna is driven to emit a radiation wave of conical beam shape in which a desired directivity does not need the gain in the front direction, whereby the circumstance in the front direction hardly affects the characteristic of the microstrip antenna. From this viewpoint, the antenna for the high frequency band is stacked at the center of the antenna for the low frequency band, whereby a predetermined directivity can be provided by the microstrip antenna of small size and having a simplified arrangement according to this embodiment.

If the drive frequencies become close to each other, the resonant frequency of the circular conductive element 13 of a middle-sized diameter is lowered by the influence of the upper dielectric layer 14 (see FIG. 12).

Figure 15:
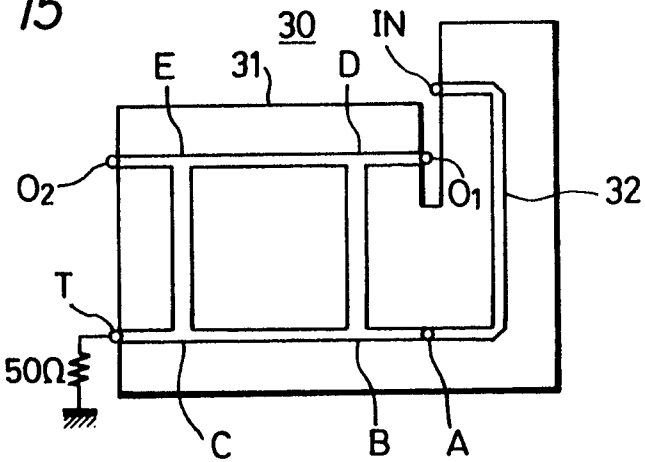
FIG. 15 shows a hybrid circuit used in the second embodiment of the microstrip antenna according to the present invention.

While in the second embodiment the feed points 13$_{f1}$ and 13$_{f2}$ of the circular conductive element 13 of a middle-sized diameter are respectively supplied with the high frequency signals having the predetermined phase difference therebetween from the coaxial feed lines 21 and 22 as described above, the overall arrangement of the microstrip antenna system can be made more compact in size by utilizing a hybrid circuit 30 shown in FIG. 15.

Referring to FIG. 15, if one copper foil 32 of a double-faced copper-bonded laminate layer 32 using fluoroplastics having a thickness of, for example, 0.8 mm is constructed as shown in FIG. 15 and the hybrid circuit 30 is supplied with a signal from its input terminal IN, then the left-hand side of the hybrid circuit 30 from its point A becomes symmetrical with respect to both the vertical and horizontal directions. The lengths of the line portions BC and BD are selected to be substantially ¼ of the effective wavelength, and the signal power at the point A is equally divided and fed to two output terminals $0_1$ and $0_2$. Simultaneously, the phase of the signal at the output terminal $O_2$ is delayed by 90 degrees. In FIG. 15, reference letter T designates a terminating resistor terminal. If the distance between the two output terminals $O_1$ and $O_2$ is selected to be equal to the distance between the feed points 13$f_1$ and 13$f_2$ shown in FIG. 11, then the hybrid circuit 30 is bonded back to back with the ground planar conductive element 11, whereby the corresponding output terminals and the feed points can be connected by conductor pins (not shown) with ease.

When such a matching circuit and the small diameter portion of the above-noted antenna are formed from the double-faced copper-bonding laminate plate and are bonded to the ground planar conductive element 11 and the middle-sized diameter circular conductive element 13, in order to more positively couple them mechanically and electrically, it is usual that the other small-diameter circular conductive element of the small diameter portion of the antenna is soldered to the middle-sized diameter circular conductive element 13 and the ground planar conductive element of the matching circuit is soldered to the ground planar conductive element 11 of the antenna.

In that event, the portion to be soldered is not exposed so that only the small diameter portion and the peripheral edge portion of the matching circuit can be soldered according to the normal soldering-process. Thus, the soldering-process is difficult to make.

The connected portion of relatively large area can be soldered over the whole area by a reflowing-process utilizing a solder having a low melting point, which needs plenty of time. Also, there is presented such a problem that the fluctuation of relative positions of respective portions cannot be restricted without difficulty.

Further, the microstrip antenna of the invention is driven in the SHF (super high frequency) band so that the length of the connection pin, which connects the feed point 15*f* of the small-diameter circular conductive element 15 and the antenna side terminal of the matching circuit, becomes important for the predetermined dimensions illustrated in the example of FIG. 6. Therefore, the disturbance of impedance at that portion exerts a bad influence upon a transmission characteristic.

Figure 16:
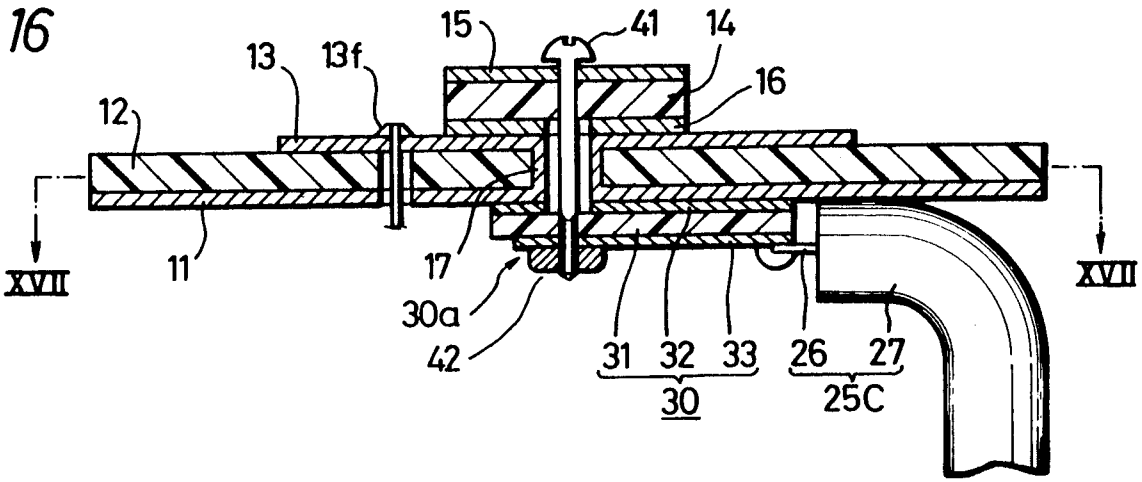
FIG. 16 shows a microstrip antenna according to a third embodiment of the present invention.

In a third embodiment of the present invention, as shown in FIG. 16, the hybrid or matching circuit 30 is comprised of a fluoroplastic layer 31 having a proper thickness, and a conductive element 32 forming one of a double-faced copper-bonding laminate layer and a conductive element 33 forming the other conductive element of the double-faced copper-bonding laminate layer, wherein the fluoroplastic layer 31 is interposed between the conductive elements 32 and 33, the conductive element 32 is employed as the ground planar conductive element and the conductive element 33 is arranged to have a predetermined pattern. The ground planar conductive element 32 is brought in contact with the ground planar conductive element 11 of the antenna.

Further, as shown in FIG. 16, a screw 41 made of a conductive material extends from the center of the small-diameter circular conductive element 15 of the antenna through the inside of a through-hole conductive layer 17 formed between the middle-sized diameter circular conductive element 13 and the ground planar conductive element 11 so as to project to the underside of an antenna side terminal 30*a* of the matching circuit 30.

Figure 17:
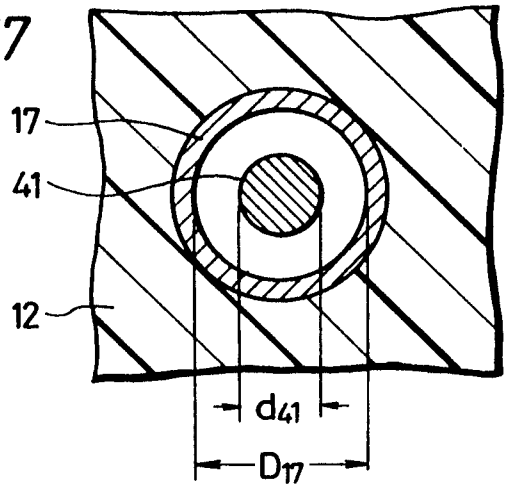
FIG. 17 is a top plan view of a main portion of the microstrip antenna, of FIG. 16 in cross-section along line XVII—XVII.

In the intermediate portion of the screw 41, its diameter $d_{41}$ and the inner diameter $D_{17}$ of through-hole conductive layer 17 (refer to FIG. 17) are selected so as to satisfy the following equation (6)

$$D_{17}/d_{41} = \approx 2.3 \quad (6)$$

The intermediate portion of the screw 41 and the through-hole conductive layer 17 provided as the outside conductor constitute a coaxial line whose characteristic impedance is 50Ω.

As shown in FIG. 16, a screw thread is threaded on the tip end portion of the screw 41 and is engaged with a nut 42 made of a conductive material, whereby the small-diameter portion and the large-diameter portion of the antenna and the matching circuit 30 are fastened together. Thus, the center of the small-diameter circular conductive element 15, i.e. the feed point, and the antenna side terminal 30*a* of the matching circuit 30 are connected via the conductive screw 41 and the conductive nut 42. An inside conductor 26 of a semi-rigid coaxial feed line 25C is soldered to the other terminal of the matching circuit 30. An outside conductor 27 of this coaxial feed line 25C is soldered to the ground planar conductive element 11.

Although the feed point 13*f* of the middle-sized diameter circular conductive element 13 is also connected to a phase difference feed circuit of strip line type by a feed pin, they are not shown for simplicity.

In the third embodiment, since the microstrip antenna is constructed as described above, the central feed point of the small-diameter circular conductive element 15 of the antenna and the terminal 30*a* of the matching circuit 30 can be positively connected via the conductive screw 41 and the conductive nut 42. Simultaneously, the small diameter portion and the large diameter portion of the antenna and the matching circuit 30 can be coupled positively. Since the above three members are coupled by the screw 41 and the nut 42, they can be coupled with great ease, which provides an improved working efficiency.

Further, the central portion of the screw 41 and the through-hole conductive layer 17 constitute the coaxial line having the characteristic impedance of 50Ωso that no trouble occurs relative to the matching circuit 30. In addition, it is possible to determine the dimensions of the respective portions of the matching circuit 30 including the through-hole portion.

While in the third embodiment a dielectric element is not provided inside of the through-hole conductive layer 17 and air exists therein as described above, if a spacer made of fluoroplastics is filled inside of the through-hole conductive layer 17, it is possible to restrict the position of the screw 41 more accurately.

In this case, the diameter $d_{41}$ of the screw 41 and the inner diameter $D_{17}$ of the through-hole conductive layer 17 are selected as $$D_{17}/d_{41} \approx 3.2 \quad (7)$$

In the foregoing, the specific inductive capacity of fluoroplastics is selected as about 2.

Further, if a conductive bonding agent is interposed between the two ground planar conductive elements 11 and 32 of the antenna and the matching circuit 30 and between the middle-sized diameter circular conductive element 13 and the small-diameter circular conductive element 16 of the antenna respectively, then mechanical strength of the antenna can be increased.

Furthermore, while in the third embodiment the screw 41 and the nut 42 are used as the fastening members as described above, they may be replaced with a screw having threads on its respective ends and two nuts. In that event, if a nut having a large diameter is used, then it becomes possible to increase the pressing area.

A fourth embodiment of the present invention will be described hereinbelow with reference to FIGS. 18 and 19.

Figure 19:
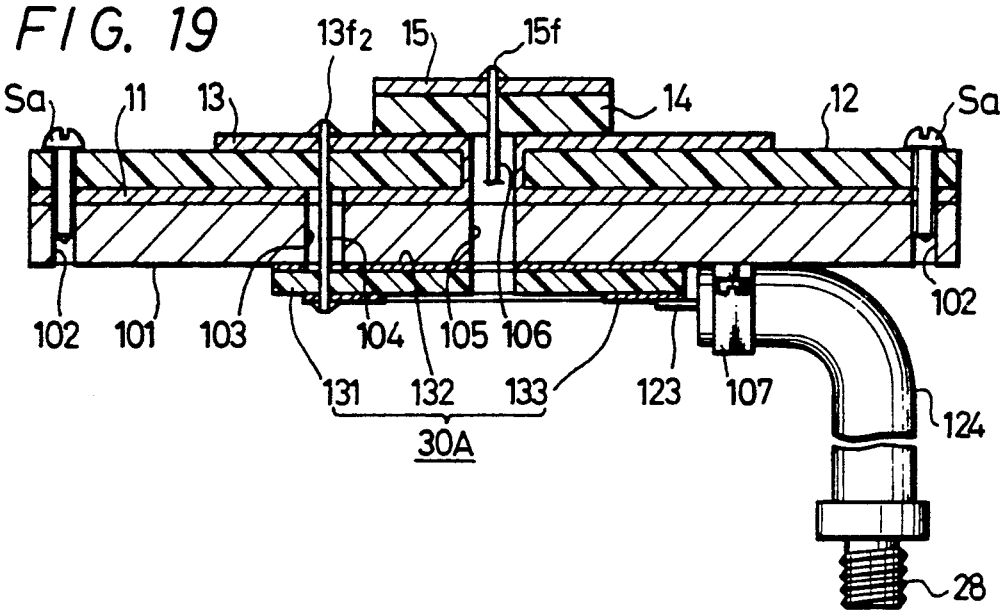
FIG. 19 shows the microstrip antenna of FIG. 18 in cross-section along line XIX—XIX.
Figure 18:
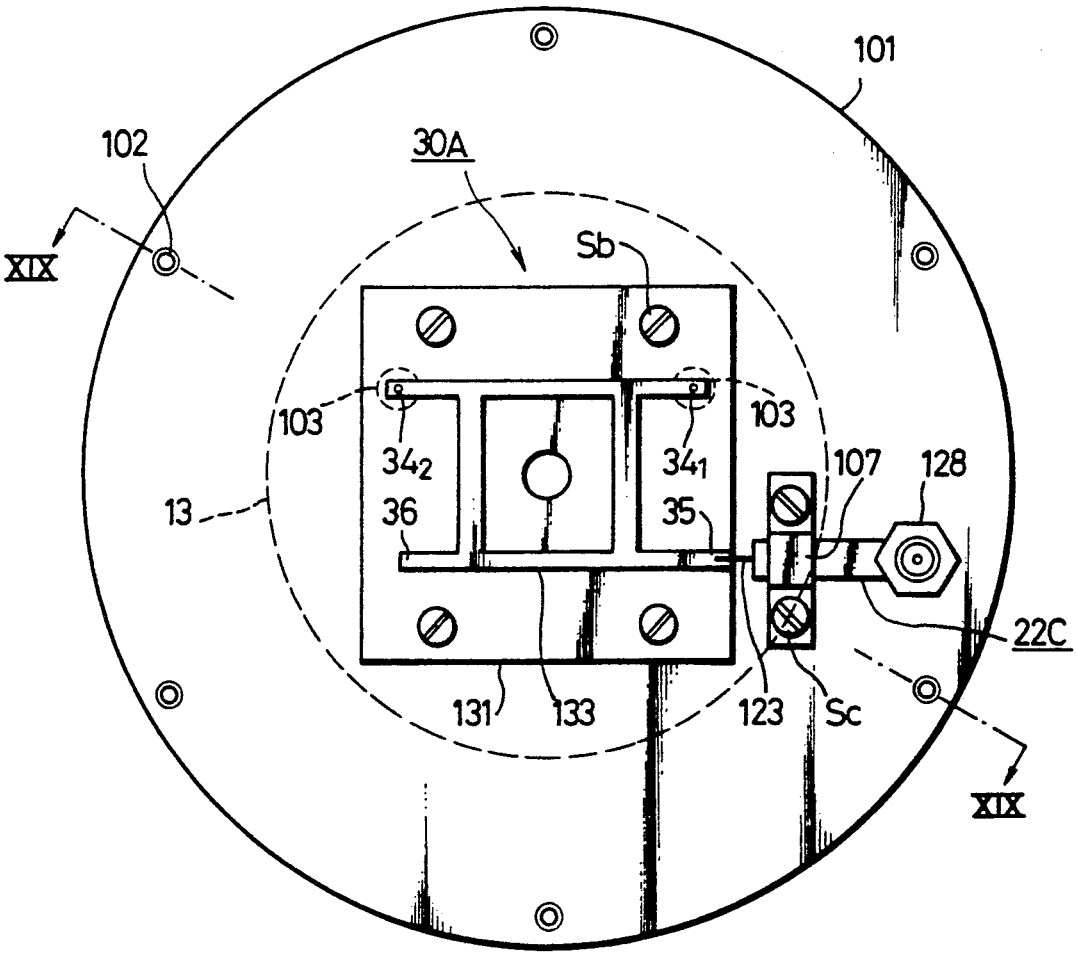
FIG. 18 is a top plan view of the microstrip antenna according to a fourth embodiment of the present invention.

Referring to FIGS. 18 and 19, there is shown a conductive substrate 101 which is made of an aluminum plate whose thickness is, for example, 3 mm. A plurality of screw apertures 102 are formed through the conductive substrate 101, on its peripheral edge portion, and the ground planar conductive element 11 is brought in contact with one surface of the conductive substrate 101 and the antenna is then fixed thereto by inserting screws Sa into the apertures 102. Through-holes 103 and 105 are bored through the conductive substrate 101 in association with two feed points $13f_1$ and $13f_2$ of the middle-diameter circular conductive element 13 of the antenna and the feed point $15_f$ of the small diameter circular conductive element 15 of the antenna, respectively.

A hybrid circuit 30A is mounted on the other surface of the conductive substrate 101 by screws Sb while its ground planar conductive element 132 is brought into contact with the conductive substrate 101 as shown in FIG. 19. One output terminal $34_2$ of the hybrid circuit 30A and one feed point $13f_2$ of the middle-sized diameter circular conductive element 13 are soldered to respective ends of a feed pin 104 which extends through the through-hole 103 of the conductive substrate 101, thus the output terminal $34_2$ and the feed point $13f_2$ being connected to each other. The other feed point $13f_1$, though not shown, and an output terminal $34_1$ are similarly connected. As shown in FIGS. 18 and 19, an inside conductor 123 of a semi-rigid coaxial feed line 22C is soldered to an input terminal 35 of the hybrid circuit 30A. The coaxial feed line 22C is secured to the conductive substrate 101 by a support metal fitting 107, screws Sc and the like.

While the feed point $15_f$ of the small-diameter conductive element 15 is also connected to the strip line type matching circuit by a feed pin 106 which extends through the through-hole 105 of the conductive substrate 101, this will not be shown in detail for simplicity.

According to the fourth embodiment, the microstrip antenna is constructed as described above, whereby the ground planar conductive element 11 of the antenna and the ground planar conductive element 132 of the hybrid circuit 30A are positively connected via the conductive substrate 101. Simultaneously, the outside conductor 124 of the coaxial feed line 22C and the ground planar conductive element 132 of the hybrid circuit 30A are positively connected in a like manner.

The two ground planar conductive elements 11 and 132 are connected via the screws Sa, Sb and the conductive substrate 101 with great ease, which provides an improved working efficiency.

While in the fourth embodiment the antenna and the hybrid circuit 30A are both provided with the ground planar conductive elements 11 and 132, the ground planar conductive elements 11 and 132 may be removed.

Further, it is possible to make the conductive substrate 101 light in weight by reducing the thickness of the conductive substrate 101 on the surface of which the hybrid circuit 30A is attached except its portions in contact with the hybrid circuit 30A and near the screw apertures 102 formed on the peripheral edge of the conductive substrate 101.

Further, when the antenna is provided with the ground planar conductive element 11, the thickness of the surface of the substrate 101 facing the antenna can be reduced except for its portions near the through-holes 103 and 105 and the screw aperture (not shown) for the screws Sb within the area opposing the hybrid circuit 30A.

While in the fourth embodiment the hybrid circuit 30A is the non-shielded strip line type as described above, it might be a shielded strip line type.

A fifth embodiment of the present invention will be described with reference to FIGS. 20 and 21.

Figure 20:
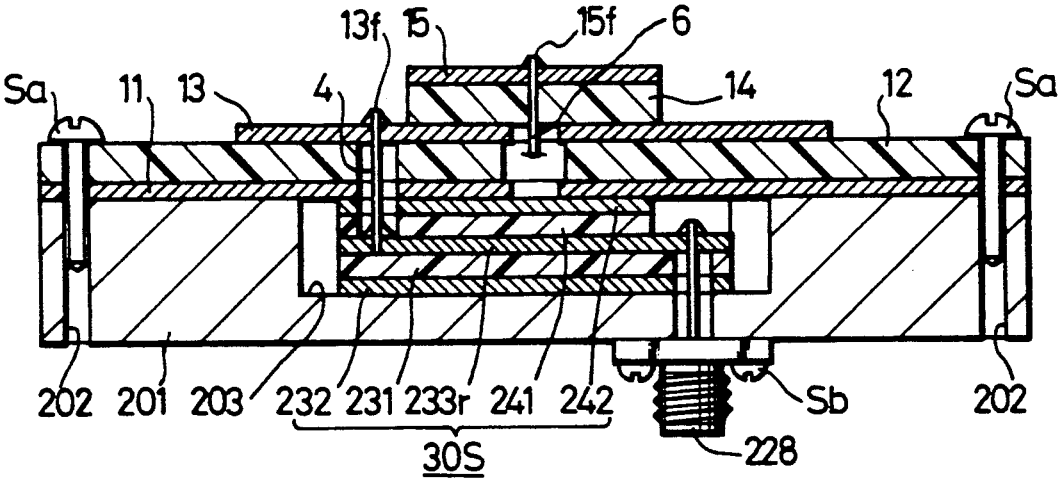
FIG. 20 shows the microstrip antenna according to a fifth embodiment of the present invention.

Referring to FIG. 20, there is provided a conductive housing 201 which is made of, for example, aluminun. A plurality of screw apertures 202 are formed around the peripheral edge of the housing 201. A concave or recess portion 203 is formed on the central portion of the upper surface of the conductive housing 201, and a hybrid circuit 30S is accommodated within the recess 203.

Figure 21:
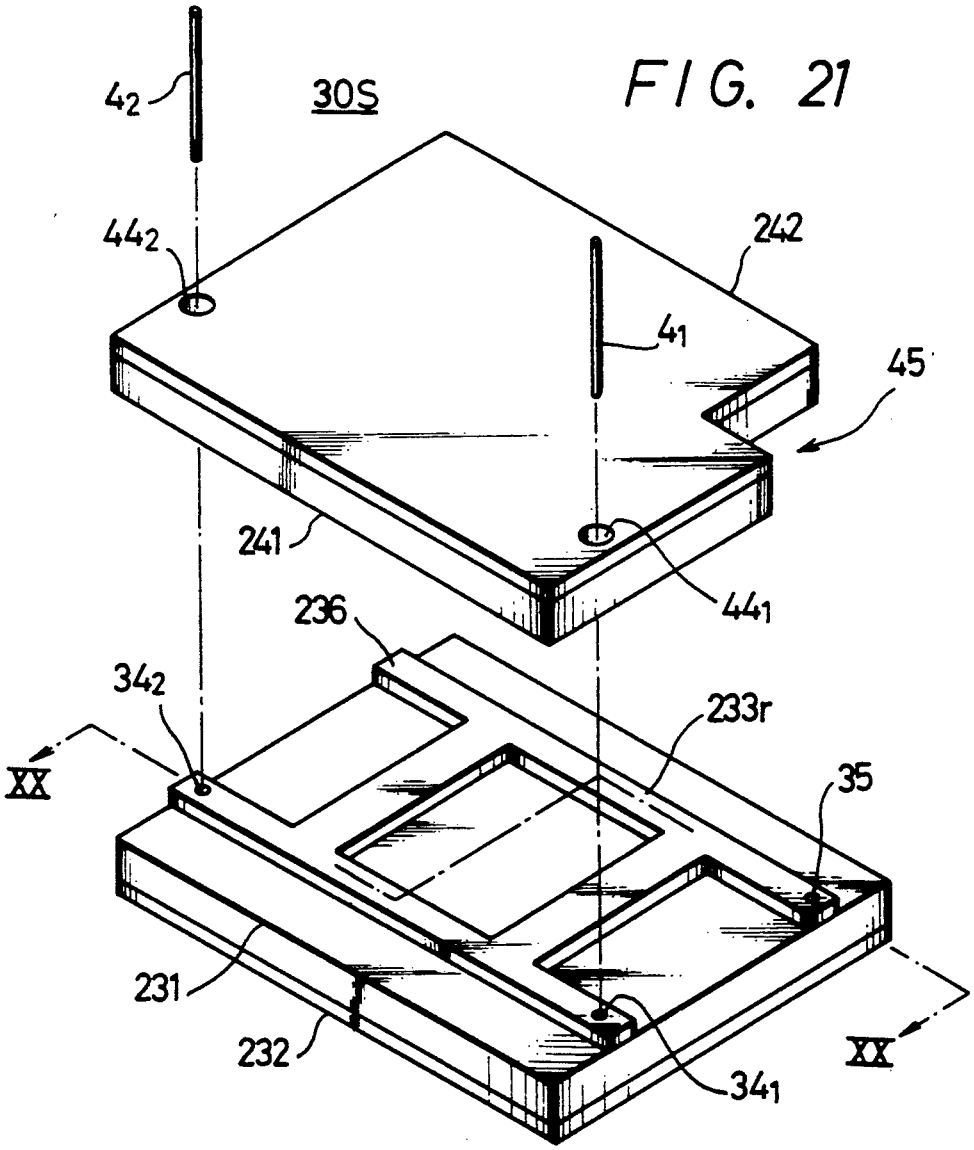
FIG. 21 is a view of an unassembled hybrid circuit used in the microstrip antenna of FIG. 20.

As shown in FIG. 21 forming an exploded view of the fifth embodiment, this hybrid circuit 30S is of a shielded strip line type in which a pattern conductive element **233*r* is sandwiched between ground planar conductive elements 232 and 242 via dielectric layers 231 and 241**.

The pattern conductive element **233*r* in FIG. 21 and the pattern conductive element 133 in FIG. 18 are placed in an inside and outside relationship. Further, FIG. 20 is a diagrammatic view for a cross-section taken along the section line XX —XX in FIG. 21**.

The depth of the recess portion 203 of the conductive housing 201 is selected to be equal to the thickness of the hybrid circuit 30S, and the ground planar conductive element 11 is brought into contact with the upper ground planar conductive element 242 of the hybrid circuit 30S and the upper surface of the conductive housing 201, thus mounting the antenna by screws Sa.

A coaxial connector 228 is secured to the lower surface of the conductive housing 201 by screws Sb.

The microstrip antenna of this embodiment is assembled in the following order:

(1) The coaxial connector 228 is secured to the under surface of the conductive housing 201 by the screws Sb;

(2) The main portion of the hybrid circuit 30S, i.e. the portion below its pattern conductor **233*r*, is located within the recess 203 of the upper surface of the conductive housing 201 under the condition that the ground planar conductive element 232 is directed downward, and the input terminal 35 of the pattern conductive element 233*r* and the inside conductor of the coaxial connector 228** are soldered to each other;

(3) Pins $4_1$ and $4_2$ are respectively implanted on and soldered to output terminals $34_1$ and $34_2$ of the pattern conductive element **233*r***;

(4) The dielectric layer 241 and the ground planar conductive element 242 are mounted on the pattern conductive element **233*r***, and the pins $4_1$ and $4_2$ are respectively projected from through-holes $44_1$ and $44_2$;

(5) When the antenna is mounted on the upper surface of the conductive housing 201 by screws, the upper ground planar conductive element 242 of the hybrid circuit 30S comes in contact with the ground planar conductive element 11 of the antenna, and the pins $4_1$ and $4_2$ are extended through the ground planar conductive element 11 and the dielectric layer 12 of the antenna and are exposed on feed points $13f_1$ and $13f_2$ of the middle-sized diameter circular conductive element 13; and (6) The feed points $13f_1$ and $13f_2$ are soldered to the corresponding pins $4_1$ and $4_2$, respectively.

According to the fifth embodiment, the microstrip antenna is constructed as described above, whereby the ground planar conductive element 11 of the antenna and the two ground planar conductive elements 232 and 242 of the hybrid circuit 30S are positively connected via the conductive housing 201, and the outside conductor of the coaxial connector 228 and the two ground planar conductive elements 232 and 242 of the hybrid circuit 30S are positively connected in the same fashion.

The connection of the ground planar conductive elements 11, 232 and 242 is effected by the screws Sa, Sb and the conductive housing 201 with great ease, which provides an improved working efficiency.

While in the fifth embodiment the hybrid circuit 30S includes the ground planar conductive elements 232 and 242 as described above, the ground planar conductive elements 232 and 242 might be removed. In that event, the bottom of the recess 203 of the conductive housing 201 and the ground planar conductive element 11 of the antenna are shielded.

Further, it is also possible to remove both the dielectric layer 241 and the ground planar conductive element 242 which are provided above the pattern conductive element **233*r*. In that event, the main portions of the pattern conductive element 233*r* side are properly secured to the conductive housing 201 by screws and the like. Also, the predetermined dimension of the pattern of the pattern conductive element 233*r*** is slightly increased.

Further, the under surface of the conductive housing 201 except the concave portion 203 accommodating the hybrid circuit 30S and the peripheral edge portion near the screw apertures 202 is properly reduced in thickness so that the weight of the microstrip antenna of the fifth embodiment can be reduced.

While in the above-mentioned embodiments two frequency bands are employed, the present invention can be similarly applied to the case where three frequency bands or more are employed.

Having described preferred embodiments of the invention in detail with reference to the accompanying drawings, it is to be understood that the present invention is not limited to those precise embodiments and that many changes and modifications could be effected by one skilled in the art without departing from the spirit or scope of the invention as defined in the appended claims.

I claim as my invention:

1. A microstrip antenna comprising:

(1) a conductive planar element that is grounded to provide a ground plane;

(b 2) a plurality of conductive, circular, radiation elements all coaxially stacked from the top downward in order of increasing diameter on a top surface of said conductive planar element, each adjacent pair of said ground plane and circular radiation elements being separated by a respective dielectric layer;

(3) a first feed point located at the center of a first one of said circular radiation elements, said first circular radiation element being located at the top of said stacked plurality of radiation elements and having the smallest diameter of said plurality thereof; and (4) other feed points provided on said circular radiation elements other than said first circular radiation element, at respective positions offset from their centers;

wherein said first circular radiation element is resonated in the $TM_{01}$ mode.

2. A microstrip antenna according to claim 1, comprising:

first feed means connected to said first feed point of said first circular radiation element; and second feed means connected to said feed points of said other circular radiation elements.

3. A microstrip antenna according to claim 1, wherein:

said first feed means includes an inside conductor connected to said first feed point of said first circular radiation element and an outside conductor connected to and extending through said other conductive circular elements at respective central portions thereof; and said inside and outside conductors having respective shapes and being arranged with respect to each other such that they are coaxial.

4. A microstrip antenna according to claim 2, wherein said first feed means includes a conductive fastening member extending from the underside of said ground plane element to substantially the center of said first circular radiation element, said first feed point of said first circular radiation element being fed through said fastening member for said resonation thereof in said $TM_{01}$ mode.

5. A microstrip antenna according to claim 2, wherein:

said second feed means includes a stripline type of feed circuit mounted on a conductive substrate which is connected to a bottom surface of said ground plane element, said ground plane element being circular and having a larger diameter than any of said plurality of circular elements stacked on said top surface thereof; and an output terminal of said feed circuit of said second feed means and said feed point of a respective one of said circular radiation elements are connected through an opening in said conductive substrate.

6. A microstrip antenna according to claim 2, wherein:

said second feed means includes a conductive housing having a recess formed in a first surface of said conductive housing;

said first surface of said conductive housing is mounted on a surface of said ground plane element that is opposite from the surface of said ground plane element on which said conductive circular elements are stacked;

a coaxial connector is mounted on the other surface of said conductive housing, wherein said coaxial connector and an input terminal of a shielded stripline feed circuit are connected via said conductive housing, and a plurality of output terminals of said shielded stripline feed circuit and said points of said antenna are connected together.

7. A microstrip antenna according to claim 1, wherein:

said ground plane element is circular with a larger diameter than any of said circular radiation elements stacked on said top surface thereof; and each said dielectric layer is circular with a diameter substantially equal to the diameter of the respective conductive circular element immediately above it.

8. A microstrip antenna according to claim 1, comprising said plurality of circular radiation elements being two in number.

9. A microstrip antenna according to claim 8, comprising two of said other feed points on the one of said circular radiation elements having the larger diameter.

10. A microstrip antenna according to claim 9, wherein said circular radiation element having the larger diameter, said ground plane element and said dielectric layer therebetween are formed of a clad dielectric member having a conducting layer extending on the top and bottom surfaces thereof and extending continuously from said top of said bottom surface along the wall of a central hole in said dielectric member.

11. A microstrip antenna according to claim 2, wherein:

each said feed means comprises a hybrid circuit mounted below said ground plane element on which said plurality of circular radiation elements are stacked, with respective vertical connections extending without electrical contract through said ground plane element to connect each respective one of said feed points of said circular radiation elements to respective points of said hybrid circuits; and the frequency of said first feed means being substantially higher than that of said second feed means.

12. A microstrip antenna comprising:

a conductive planar element that is grounded to constitute a ground plane element;

a planar radiation element of substantially circular shape provided on said ground plane element via a dielectric layer of substantially the same diameter as said circular radiation element;

a feed point located at substantially the center of said circular radiation element; and feed means connected to said feed point of said circular radiation element and to said ground plane element for said grounding thereof;

wherein said radiation element is capable of being resonated substantially only in the $TM_{01}$ mode;

wherein said feed means includes impedance matching means for connection of said feed point of said circular radiation element to a coaxial cable with impedance matching of the cable to the antenna;

said impedance matching means includes an inside conductor connected to said feed point of said circular radiation element and an outside conductor connected to said ground plane element; and said inside and outside conductors are shaped and arranged with respect to each other so as to be coaxial; and said outside conductor is connected at its top portion to substantially a central portion of said ground plane element for said grounding thereof;

said inside conductor has a bottom portion of a first diameter and a top portion of a second diameter that is smaller than said first diameter; and said outside conductor has a constant inside diameter and extends the entire length of said bottom portion of said inside conductor and a part of the length of said top portion of said inside conductor.

13. A microstrip antenna comprising:

a conductive planar element that is grounded to constitute a ground plane element;

a planar radiation element of substantially circular shape provided on said ground plane element via a dielectric layer of substantially the same diameter as said circular radiation element;

a feed point located at substantially the center of said circular radiation element; and feed means connected to said feed point of said circular radiation element and to said ground plane element for said grounding thereof;

wherein said radiation element is capable of being resonated substantially only in the $TM_{01}$ mode;

wherein said feed means includes impedance matching means for connection of said feed point of said circular radiation element to a coaxial cable with impedance matching of the cable to the antenna;

said impedance matching means includes an inside conductor connected to said feed point of said circular radiation element and an outside conductor connected to said ground plane element; and said inside and outside conductors are shaped and arranged with respect to each other so as to be coaxial; and said outside conductor is connected at its top portion to substantially a central portion of said ground plane element for said grounding thereof;

said ground plane element is circular with a larger diameter than that of said circular radiation element;

a further conductive planar element is provided under said ground plane element, and separated therefrom by a further dielectric layer of diameter substantially equal to that of said ground plane element;

said outside conductor of said impedance matching means extends through and is in contact with a middle portion of said further conductive planar element;

said ground plane element has a plurality of feed points located away from the center thereof; and further feed means are connected to said feed points of said ground plane element, said further feed means corresponding to a substantially lower frequency than that of said feed means for said resonating of said circular radiation element in said $TM_{01}$ mode, wherein a signal of said feed points away from the center of said ground plane element at said lower frequency has different phases at each such feed point;

wherein said ground plane element and said further conductive planar element comprise an antenna for said lower frequency.

14. A two-frequency microstrip antenna comprising:

a conductive planar element that is grounded to constitute a ground plane element;

a planar radiation element of substantially circular shape provided on said ground plane element via a dielectric layer of substantially the same diameter as said circular radiation element;

a feed point located at substantially the center of said circular radiation element; and feed means connected to said feed point of said circular radiation element and to said ground plane element for said grounding thereof;

wherein said radiation element is capable of being resonated substantially only in the $TM_{01}$ mode; and said circular radiation element and said ground plane element are operated by said feed means at a first frequency;

a further planar conductive element of size larger than said ground plane element is connected beneath said ground plane element and grounded at a central part thereof in common with said ground plane element;

said ground plane element is provided with a plurality of off-center feed points; and further feed means are connected to said off-center feed points and provided to correspond to different phases at the different ones of said off-center feed points for a substantially lower frequency from said first frequency.

15. A two-frequency microstrip antenna according to claim 14, wherein:

said further feed means comprises a hybrid circuit having a pattern of conducting striplines;

said hybrid circuit is mounted below a bottom surface of said further planar conductive element; and a plurality of connections are provided through, and insulated from, respective parts of said further conductive planar element, to contact each said off-center feed point of said ground plane element to a respective point of said pattern of conducting striplines of said hybrid circuit.

16. A two-frequency microstrip antenna according claim 15, wherein said hybrid circuit is of a non-shielded stripline type.

17. A two-frequency microstrip antenna according claim 15, wherein said hybrid circuit is of a shielded stripline type.

* * * * *